US009828206B2

(12) United States Patent
Pasquet et al.

(10) Patent No.: US 9,828,206 B2
(45) Date of Patent: Nov. 28, 2017

(54) METHOD OF WINDING A CONDUCTOR IN DOUBLE PANCAKE

(71) Applicant: Commissariat à l'énergie atomique et aux énergies alternatives, Paris (FR)

(72) Inventors: Raphaël Pasquet, Plaisir (FR); Thierry Schild, Orsay (FR); Christophe Berriaud, Bures sur Yvette (FR); Loris Scola, Morangis (FR)

(73) Assignee: COMMISSARIAT À L'ÉNERGIE ATOMIQUE ET AUX ÉNERGIES ALTERNATIVES, Paris (FR)

( * ) Notice: Subject to any disclaimer, the term of this patent is extended or adjusted under 35 U.S.C. 154(b) by 473 days.

(21) Appl. No.: 14/568,778

(22) Filed: Dec. 12, 2014

(65) Prior Publication Data

US 2015/0179338 A1 Jun. 25, 2015

(30) Foreign Application Priority Data

Dec. 19, 2013 (FR) ..... 13 62981

(51) Int. Cl.
*H01F 27/00* (2006.01)
*B65H 54/00* (2006.01)
(Continued)

(52) U.S. Cl.
CPC ..... *B65H 54/00* (2013.01); *H01F 6/06* (2013.01); *H01F 27/2871* (2013.01); *H01F 41/084* (2016.01); *Y10T 29/49014* (2015.01)

(58) Field of Classification Search
CPC ..... B65H 54/02; B65H 54/04; B65H 55/02; B65H 59/02; H01F 27/2871; H01F 41/084; Y10T 29/49014
See application file for complete search history.

(56) References Cited

U.S. PATENT DOCUMENTS 3,307,247 A 3/1967 Parker
5,531,015 A * 7/1996 Manlief ..... H01F 6/06 174/125.1
(Continued)

FOREIGN PATENT DOCUMENTS

EP 2 075 805 A1 7/2009

OTHER PUBLICATIONS

M. D. Sumption et al., "Wind and React and React and Wind $MgB_2$ Solenoid, Racetrack and Pancake Coils," IEEE Transactions on Applied Superconductivity, vol. 17, No. 2, Jun. 2007; pp. 2286-2290.
(Continued)

*Primary Examiner* — Emmanuel M Marcelo
(74) *Attorney, Agent, or Firm* — Pillsbury Winthrop Shaw Pittman LLP

(57) ABSTRACT

A method of winding a conductor in double pancake, including a first pancake and a second pancake, a reel initially containing the conductor, the method including: a first step in which the reel is placed on a tensioner and a first portion of the conductor is wound around a storage volume; a second step in which a first part of the conductor is inserted in a winding mandrel to change the layer; a third step in which a second portion of the conductor is wound around a first part of the storage volume so as to form a first pancake; a fourth step in which the first portion of the conductor is unwound from the storage volume and is wound around the reel; and a fifth step in which the first portion of the conductor is wound around a second part of the storage volume to form a second pancake.

13 Claims, 2 Drawing Sheets

(51) Int. Cl.

| | |
|---|---|
| ***H01F 6/06*** | (2006.01) |
| ***H01F 27/28*** | (2006.01) |
| ***H01F 41/084*** | (2016.01) |

(56) References Cited

U.S. PATENT DOCUMENTS

| | | | | |
|---|---|---|---|---|
| 8,344,835 | B1 | 1/2013 | Ko et al. | |
| 2006/0071747 | A1* | 4/2006 | Friedman | H01F 6/06 335/216 |
| 2013/0065767 | A1* | 3/2013 | Schauwecker | H01F 6/06 505/211 |
| 2013/0113587 | A1* | 5/2013 | Inoue | H01F 30/12 336/5 |

OTHER PUBLICATIONS

Preliminary Search Report issued in French Patent Application No. 1362981, dated Jul. 25, 2014.

* cited by examiner

METHOD OF WINDING A CONDUCTOR IN DOUBLE PANCAKE

CROSS REFERENCE TO RELATED APPLICATIONS

This application claims the benefit of priority from French Patent Application No. 1362981 filed on Dec. 19, 2013, the entire content of which is incorporated herein by reference.

FIELD

The invention relates to winding of a conductor and particularly a superconductor, for an electromagnet.

BACKGROUND

Superconducting materials are materials for which the electrical resistance becomes zero under some conditions. This is only possible if the superconducting material satisfies three conditions:

- its temperature must be less than a critical temperature Tc;
- it must be in a magnetic field weaker than a magnetic field Bc;
- the current passing through the material must be less than a critical current Jc.

Critical values are specific to each material. These three parameters, Tc, Bc and Jc, are dependent on each other, forming a critical surface. If the material is below the critical surface it is superconducting, otherwise it is resistive.

There are many superconducting materials, but only a small number of materials are suitable for manufacturing an electromagnet due to the small size of the critical surface. Niobium titanium (NbTi) is the most frequently used material at the present time due to its use in Magnetic Resonance Imagery (MRI) instruments and NMR (Nuclear Magnetic Resonance) spectrometers, which at the present time are the main industrial markets for superconductivity.

Niobium 3 tin ($Nb_3Sn$) is another material used for very strong field NMR spectrometers, more than 10 Tesla. Magnesium diboride ($MgB_2$), mixed bismuth strontium calcium copper oxide (BSCCO) and mixed yttrium barium copper oxide (YBaCuO) are other superconducting materials used for manufacturing electromagnets, but for the moment they are only used in research and development.

$MgB_2$ has the advantage that it is inexpensive, it is very easy to use and its performance is better than NbTi at equivalent temperature for a magnetic field of less than 4 T, and the vast majority of MRI apparatuses operate with a magnetic field of between 1.5 T and 3 T. The increase in operating temperature means that "dry" cooling by conduction at between 10 and 20 K can be used instead of so-called wet cooling in a liquid helium bath at 4.2 K.

Two types of windings are widely used for the manufacture of electromagnets, and particularly superconducting magnets:

- the solenoid winding that is a layer by layer winding;
- a double pancake stack or double pancake winding, which is a turn by turn winding.

Usually, a solenoid winding is used because it is easy to make, and is fast and inexpensive. However, a long individual conducting length is desirable for large systems, although this not always possible. In this case, i.e. a solenoid winding, junctions have to be made between the layers but this is not recommended for superconductivity.

Thus, a double pancake winding is often used to make superconducting coils at high and medium critical temperature because the industrially available individual conducting length (from 100 m to 4 km) is not sufficient to make a complete single piece coil generally requiring a few tens of km. Subsequently, a plurality of double pancakes is stacked to assemble the final electromagnet. A junction is made between each double pancake. This type of junction is easier to make than in the case of a solenoid winding because the junction is located on the outside radius of the electromagnet in a weak field zone.

In general, the double pancake winding method comprises the following steps:

- the conductor length necessary for winding a double pancake is halved. Half of the conductor is transferred from a first reel to a second reel. Each reel thus contains the conducting length necessary for winding each pancake.
- the reels are transferred onto a winding machine. One of the reels is installed on a tensioner, a system that imposes a tension in the conductor, for winding the first pancake. The second reel called the spare reel is installed above the winding table in order to kinetically tie the spare reel to rotation of the winding table to prevent the conductor on the spare reel from unwinding, while the first pancake is being produced.
- set up the layer change and wind the first pancake;
- once the first pancake has been wound, move the tensioner laterally and then transfer the spare reel onto the tensioner so as to wind the second pancake.

This double pancake winding technique was initially developed for winding the NbTi conductor. However, it is difficult to apply for $MgB_2$ conductors that, unlike NbTi conductors, are sensitive to deformations. $MgB_2$ conductors have a maximum deformation threshold above which they loose their superconducting state. This limit is relatively low which imposes a high minimum radius of curvature of the conductor. Minimum radii of curvature for a standard conductor with a cross-section of 0.7*3.1 $mm^2$ are 60 mm and 260 mm respectively.

It is also almost impossible to tell whether or not a conductor has been damaged during winding. Such a problem will only be observed when the magnet is finally put into operation, unless every double pancake is tested independently which is long and expensive. Since it is impossible for a superconducting magnet to be partially resistive, if there is a defect in a double pancake, then the magnet will have to be disassembled and the double pancake will have to be replaced. Thus, risks of conductor damage during winding must be limited.

The following steps are particularly critical for a fragile conductor such as $MgB_2$:

- operations to split the reels and transfer them onto the winding machine, the conductor between the two reels being free to move and therefore can be damaged;
- shaping of the layer change in a special tool, the conductor is then turned back in the winding mandrel, the conductor is then free to move and can be damaged;
- the operation to transfer the spare reel onto the tensioner for winding the second pancake because the conductor usually has to be unwound to be put on the tensioner. The conductor is also blocked at the exit from the layer change which creates a stress concentration point, therefore the conductor can easily be damaged.

These problems are critical for superconductors, but they also exist for other conductor windings, regardless of whether or not the conductor is insulated and whether or not it is superconducting.

SUMMARY

An aspect of the invention aims to overcome some or all of the disadvantages of the state of the art identified above, and particularly to propose a winding method that limits risks of damage to the conductor.

To achieve this, an embodiment of the invention relates to a method of winding a conductor in double pancake, the double pancake comprising a first pancake and a second pancake and a reel initially containing said conductor, the method comprising:

- a first step in which the reel is placed on a tensioner and a first portion of the conductor is wound around a storage volume;
- a second step in which a first part of the conductor is inserted in a winding mandrel in order to change the layer;
- a third step in which a second portion of the conductor is wound around a first part of the mandrel so as to form a first pancake;
- a fourth step in which the first portion of the conductor is unwound from the storage volume and is wound around the reel;
- a fifth step in which the first portion of the conductor is wound around a second part of the mandrel so as to form a second pancake.

Thus, the conductor separation and transfer operations have been eliminated which avoids risks of damage to the conductor that existed previously. This method also keeps the conductor permanently under tension, which thus prevents any unwanted movement of the conductor.

Apart from the main characteristics described in the previous section, the method according to an embodiment of the invention may have one or several of the following complementary characteristics taken individually or in any technically possible combination:

- in the first step, the reel is placed at a first part of the tensioner, the reel possibly being moved between the first part of the tensioner and a second part of the tensioner; the first portion of the conductor is wound between a first part of the storage volume and a second part of the storage volume in a first rotation direction due to displacement of the reel between the first part of the tensioner and the second part of the tensioner;
- the second step is done once the reel has reached the second part of the tensioner, the winding mandrel being placed at the second part of the storage volume;
- in a third step, the second portion of the conductor is wound in the first rotation direction, the reel remaining fixed at the second part of the tensioner;
- in the fourth step, the reel is initially put into position on the tensioner at the first part of the tensioner and the first portion of the conductor is unwound from the storage volume in the first rotation direction by displacement of the reel between the first part of the tensioner and the second part of the tensioner;
- in the fifth step, the first portion of the conductor is wound in a second rotation direction above the first pancake;
- in the second step, the second part of the conductor is inserted in a groove of the winding mandrel;
- in the third step, the conductor is held in position by means of a system of axial and radial pressure rollers;
- in the fourth step, the conductor is held in position by means of a system of axial and radial pressure rollers;
- in the fourth step, the tensioner is offset in the radial direction;
- in the fourth step, the reel is turned back on the tensioner axis; in the third step, the conductor forming the first pancake is clamped once the first pancake has been formed;
- the method includes a sixth step prior to the fifth step, in which an insert is positioned above the first pancake to be inserted between the first pancake and the second pancake.

BRIEF DESCRIPTION OF THE FIGURES

Other characteristics and benefits of the invention will become clear after reading the following description with reference to the appended figures that show.

For more clarity, identical or similar elements are marked by identical reference signs in all the figures.

DETAILED DESCRIPTION

Figure 1:
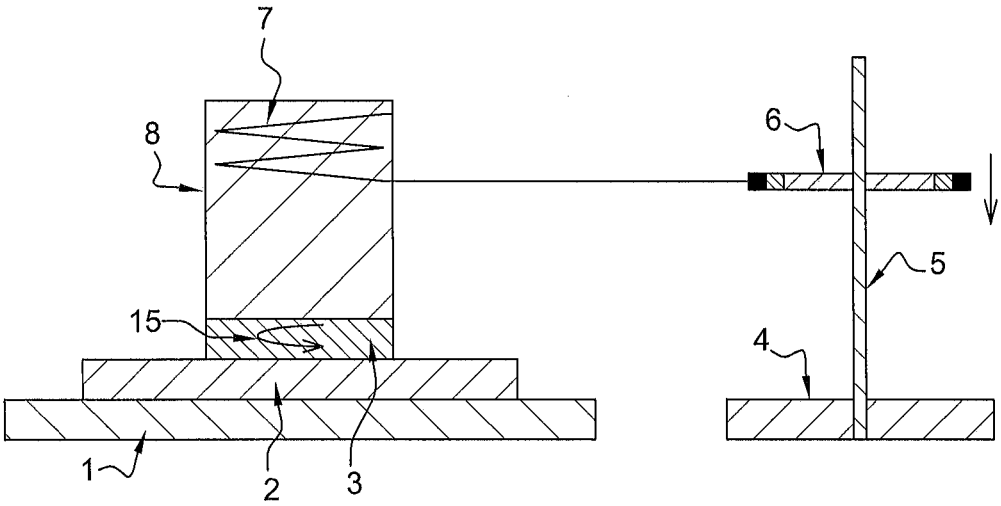
FIGS. 1 to 5, diagrammatic views of the different steps of a winding method according to an embodiment of the invention.

FIGS. 1 to 5 show the same elements, namely a winding table 1 on which there is a winding machine tray 2 and the cylinder 8 acting as the storage volume. This storage volume may be either cylindrical or conical to reduce the total height and/or to increase the radius of curvature of the conductor. It also shows a tensioner 4 comprising a support axis 5 on which there is a reel 6. The reel is a support on which conductors/wires are wound. The tensioner is a motor fitted with a brake to tension and rewind the conductors. The arrow 15 shown in FIGS. 1 to 5, shows the rotation direction of the conductor winding or unwinding.

FIG. 1 shows a first step in the winding method. The reel 6 is put into position on the support axis 5 of the tensioner 4 at a first part of the tensioner, in this case the upper end of the support axis 5 of the tensioner 4. The reel may be moved between the upper end of the support axis 5 of the tensioner and the lower end of the support axis 5 of the tensioner, the second part of the tensioner. A first portion of the conductor 7 is wound around the storage volume 8 also referred to as the spare solenoid. This first step is a step that corresponds to splitting the conductor, and unlike in prior art, it is now done directly on the winding machine. The conductor 7 placed on the reel includes the required quantity for winding the complete double pancake. The reel is initially at the upper end of the tensioner support axis 5, a first end of the conductor 7 is unwound from the reel and is attached to the storage volume 8. The conductor 7 is then tensioned using the tensioner 4 and a first portion of the conductor is then wound around the storage volume as far as the winding mandrel 3 moving the reel down along the tensioner axis 5, i.e. by moving the reel between the first part of the tensioner and the second part of the tensioner. The first conductor portion thus wound around the storage volume will be used for winding the second pancake of the double pancake.

Figure 2:
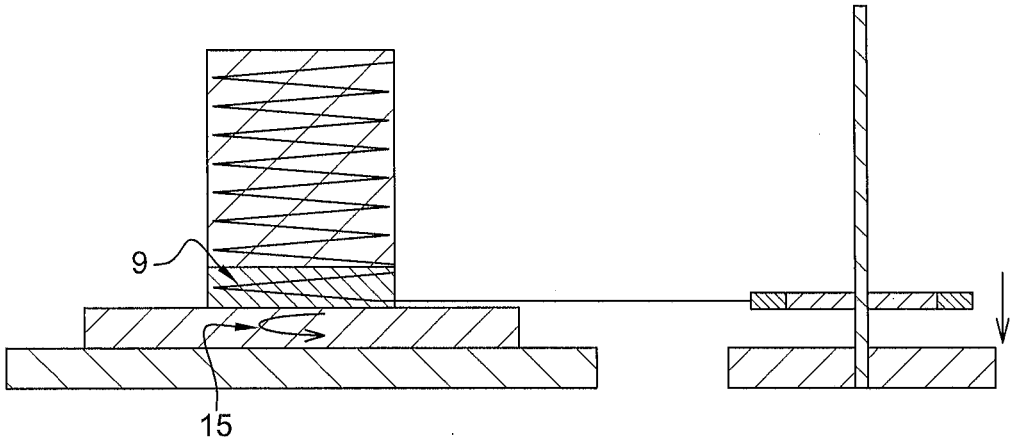

FIG. 2 shows a second step in a winding method. A first part of the conductor is inserted in a groove (not visible) in a winding mandrel 3 so that the layer change 9 between the first portion of the conductor and a second portion of the conductor can be made. The layer change is made when the reel reaches the second part of the tensioner. The winding mandrel is placed at the second part of the storage volume, in this case the lower part of the storage volume. The layer change 9 may be made with or without tension. If it is made with tension, the reel displacement speed on the tensioner is adjusted to index the angular position of the conductor at the exit from the spare cylinder so that the layer change can then be made.

Figure 3:
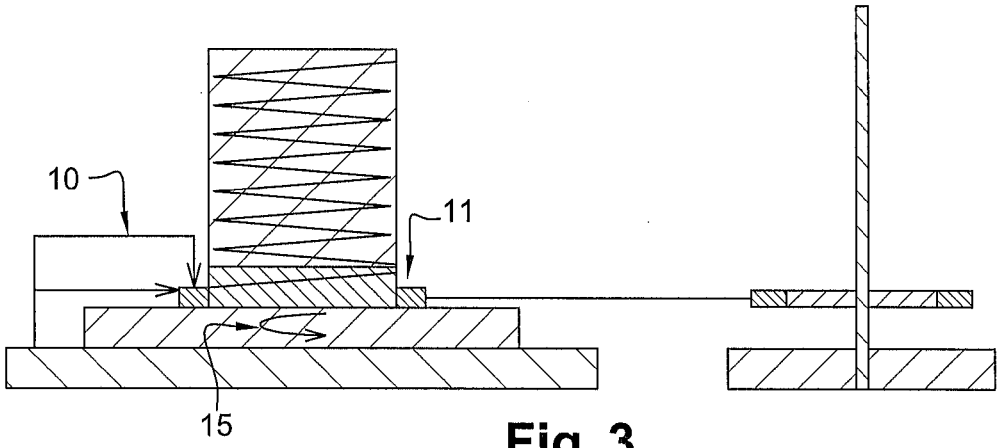

FIG. 3 shows a third step in a winding method. This third step is the step in which the first pancake of the double pancake is wound. When the reel 6 reaches the lower end of the support axis 5 of the tensioner, the second part of the tensioner, and the layer change has been made, a second portion of the conductor is wound in a first rotation direction 15, around a first part of the mandrel so as to form the first pancake 11. The reel is kept fixed in its position so that the first pancake 11 can be wound. Axial and radial pressure roller systems 10 are added to keep the conductor in position while the first pancake is being wound.

Figure 4:
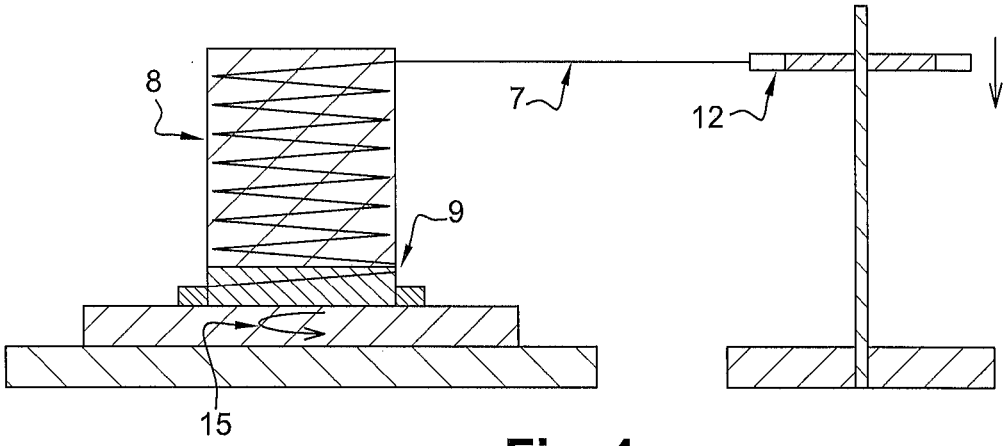

FIG. 4 shows a fourth step in a winding method that corresponds to recovery of the first portion of the conductor from which the second pancake will be formed ready for winding above the first pancake. Once the first pancake has been wound and the conductor has been clamped, the tensioner 4 is shifted in the radial direction and the empty reel 12 is returned to the first part of the tensioner, i.e. the upper end of the tensioner axis. The first portion of the conductor is then unwound from the storage volume and is wound around the empty reel in the first rotation direction moving the reel from the first part of the tensioner towards the second part of the tensioner, i.e. by moving the reel down as far as the exit from the layer change 9.

Figure 5:
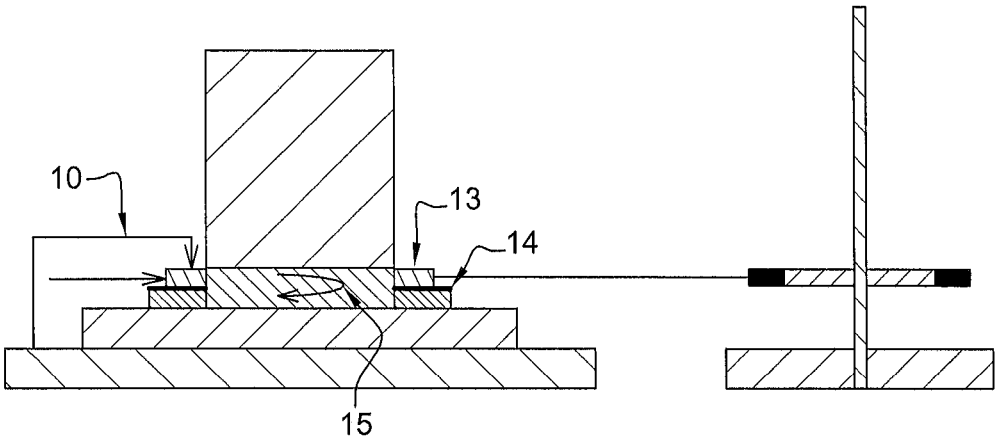

FIG. 5 shows a fifth step in a winding method that corresponds to winding the second pancake 13. The first conductor portion is wound around a second part of the mandrel. This winding takes place in a second rotation direction, i.e. by reversing the rotation direction from the previous steps. The second pancake is wound above the first pancake 11. An insert 14 can be seen in FIG. 5. This insert is placed between the first pancake 11 and the second pancake 13 and acts as the winding plate for the second pancake 13 and electrical insulation. A system of axial and radial pressure rollers 10 is installed to keep the second pancake 13 in position during winding.

The invention is not limited to the embodiments disclosed above with reference to the figures and variants could be envisaged without going outside the scope of the invention.

The invention claimed is:

1. A method of winding a conductor in double pancake, said double pancake comprising a first pancake and a second pancake, a reel initially containing said conductor, said method comprising:

placing the reel on a tensioner and winding a first portion of the conductor around a storage volume;

inserting a first part of the conductor in a winding mandrel in order to change a layer between the first portion of the conductor and a second portion of the conductor;

winding the second portion of the conductor around a first part of the winding mandrel so as to form the first pancake;

unwinding the first portion of the conductor from the storage volume and winding the first portion of the conductor around the reel, and winding the first portion of the conductor around a second part of the winding mandrel so as to form the second pancake.

2. The method according to claim 1, wherein, in said placing of the reel on the tensioner and winding the first portion of the conductor around the storage volume, the reel is placed at a first part of the tensioner, the reel possibly being moved between the first part of the tensioner and a second part of the tensioner; wherein the first portion of the conductor is wound between a first part of the storage volume and a second part of the storage volume in a first rotation direction due to displacement of the reel between the first part of the tensioner and the second part of the tensioner.

3. The method according to claim 2, wherein the inserting is done once the reel has reached the second part of the tensioner, the winding mandrel being placed at the second part of the storage volume.

4. The method according to claim 2, wherein in said winding of the second portion of the conductor around the first part of the winding mandrel so as to form the first pancake, the second portion of the conductor is wound in the first rotation direction, the reel remaining fixed at the second part of the tensioner.

5. The method according to claim 2, wherein in said unwinding of the first portion of the conductor from the storage volume and winding the first portion of the conductor around the reel, the reel is initially put into position on the tensioner at the first part of the tensioner and the first portion of the conductor is unwound from the storage volume in the first rotation direction by displacement of the reel between the first part of the tensioner and the second part of the tensioner.

6. The method according to claim 1, wherein in said winding of the first portion of the conductor around the second part of the mandrel so as to form the second pancake, the first portion of the conductor is wound in a second rotation direction above the first pancake.

7. The method according to claim 1, wherein in the inserting, the second part of the conductor is inserted in a groove of the winding mandrel.

8. The method according to claim 1, wherein in said winding of the second portion of the conductor around the first part of the winding mandrel so as to form the first pancake, the conductor is held in position by means of a system of axial and radial pressure rollers.

9. The method according to claim 1, wherein in said unwinding of the first portion of the conductor from the storage volume and winding the first portion of the conductor around the reel, the conductor is held in position by means of a system of axial and radial pressure rollers.

10. The method according to claim 1, wherein in said unwinding of the first portion of the conductor from the storage volume and winding the first portion of the conductor around the reel, the tensioner is offset in the radial direction.

11. The method according to claim 1, wherein in said unwinding of the first portion of the conductor from the storage volume and winding the first portion of the conductor around the reel, the reel is turned back on a tensioner axis of the tensioner.

12. The method according to claim 1, wherein in said winding of the second portion of the conductor around the first part of the winding mandrel so as to form the first pancake, the conductor forming the first pancake is clamped once the first pancake has been formed.

13. The method according to claim 1, further comprising, prior to winding the first portion of the conductor around the second part of the winding mandrel so as to form the second pancake, positioning an insert above the first pancake to be inserted between the first pancake and the second pancake.

* * * * *